US008152934B2

(12) United States Patent
Lee et al.

(10) Patent No.: US 8,152,934 B2
(45) Date of Patent: Apr. 10, 2012

(54) AEROENGINE WASHING SYSTEM AND METHOD

(75) Inventors: Simon E Lee, Derby (GB); Luis Ponce de Leon Saenz, Derby (GB); Pierre-Yves C A Reynaud, Derby (GB); Nicholas Anthony Salmon, Tunbridge Wells (GB); Kevin A White, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 11/878,876

(22) Filed: Jul. 27, 2007
(Under 37 CFR 1.47)

(65) Prior Publication Data

US 2008/0087301 A1 Apr. 17, 2008

(30) Foreign Application Priority Data

Jul. 27, 2006 (GB) ..... 0614874.6

(51) Int. Cl.
*B08B 3/00* (2006.01)

(52) U.S. Cl. ..... 134/36; 134/34; 134/198

(58) Field of Classification Search ..... None
See application file for complete search history.

(56) References Cited

U.S. PATENT DOCUMENTS

| | | | | |
|---|---|---|---|---|
| 4,196,020 | A | 4/1980 | Hornak et al. | |
| 6,592,057 | B1 * | 7/2003 | Ericksen et al. | 239/587.1 |
| 2006/0138262 | A1 * | 6/2006 | Colson | 241/168 |
| 2006/0266388 | A1 * | 11/2006 | Goddard | 134/94.1 |

FOREIGN PATENT DOCUMENTS

| | | | |
|---|---|---|---|
| EP | 1 452 802 | A | 9/2004 |
| GB | 2 261 178 | A | 5/1993 |
| JP | 60013927 | AB | 1/1985 |
| WO | WO 2005/077554 | A | 8/2005 |
| WO | WO 2005/120953 | A | 12/2005 |

* cited by examiner

*Primary Examiner* — Michael Barr
*Assistant Examiner* — Jason Ko
(74) *Attorney, Agent, or Firm* — Jeffrey S. Melcher; Manelli Selter PLLC

(57) ABSTRACT

An adjustable nozzle dispenser and a multi-nozzle dispenser are disclosed for washing an aerofoil of a gas turbine engine. The dispensers are characterized by their nozzle arrangements being capable of washing at least two different parts of the aerofoil. A system and a method of operating such a nozzle dispenser is included.

20 Claims, 4 Drawing Sheets

AEROENGINE WASHING SYSTEM AND METHOD

FIELD OF THE INVENTION

The present invention relates to a system and a method for washing an aeroengine and in particular, but not exclusively, fan blades and a core engine of the aeroengine.

BACKGROUND OF THE INVENTION

During the service life of a gas turbine engine and particularly aeroengines, engine derived contaminants and ingestion of airborne particles lead to a build up of matter on aerodynamic surfaces such as fan blades, compressor and turbine blades and vanes and airflow duct walls. This undesirable build-up of matter causes a loss of efficiency of the engine leading to reduced thrust and/or increased fuel burn resulting in increased environmental pollution compared to a clean engine. For the engine's operator this loss of efficiency increases fuel costs and results in shorter intervals between engine overhauls.

Aeroengine washing is well known as disclosed in WO2005/077554A1 for example. In this system engine washing is achieved using three pressurised cleaning fluid nozzles. One nozzle is arranged at a first angle to direct a jet of cleaning fluid into the core engine and the other two are angled at the pressure and suction sides of the fan-blades respectively. Blades and vanes comprise complex shapes and notably a leading edge of the blade twists along its radial length and therefore presents a changing angle of its surface to be cleaned. Therefore, this prior art engine washing nozzle system is disadvantaged as it uses three separate nozzles, that each require independently positioning and each is angled at one specific angle that is not necessarily optimal for cleaning all parts of all the surfaces of the subject component.

SUMMARY OF THE INVENTION

Therefore it is an object of the present invention to provide a washing fluid system and a method of operating the system that improves the cleaning quality of aerodynamic surfaces, uses less washing fluid and is adaptable for use on different and complex shaped components.

In accordance with the present invention multi-nozzle dispenser, for washing an aerofoil of a gas turbine engine, is characterised in that the dispenser comprises at least two nozzles each directed at different parts of a surface of the aerofoil. Preferably, at least one of the nozzles is movable and is capable of being directed at different parts of a surface of the aerofoil.

Still in accordance with the present invention a an adjustable nozzle dispenser, for washing an aerofoil of a gas turbine engine, characterised in that the nozzle is movable to wash at least two different parts of the aerofoil.

Preferably, for either the adjustable nozzle dispenser or the multi-nozzle dispenser the movement is a rotation of either the nozzle or the dispenser.

Alternatively, the movement is a translation of the nozzle or dispenser.

Preferably, the aerofoil is any one of the group comprising a fan blade, a compressor blade or vane, an outlet guide vane, a static structure or a bifurcation member, each at least one principle fluid flow surface.

Preferably, the nozzle's outlet is elongate and produces a high aspect ratio shaped jet of washing liquid. Alternatively, the nozzle outlet is substantially elliptical and produces a generally elliptical shaped jet of washing fluid.

Alternatively, the adjustable nozzle dispenser comprises at least two nozzles.

Preferably, the dispenser has at least two nozzles that are arranged at different angles to one another, and may be arranged at different angles within a first plane or a mutually perpendicular second plane. The first plane is with respect to angles between a leading edge and a trailing edge of the aerofoil.

The nozzles may be arranged at different angles within a second plane, the second plane is with respect to angles between a tip and a root of the aerofoil.

Preferably, the nozzle(s) are angled at more than 75 degrees to a surface of the aerofoil particularly where the aerofoil is not moving. It is yet more preferable, to angle the nozzle(s) between 85 degrees and 90 degrees to the surface of the aerofoil.

Where the aerofoil is rotating, it is preferable to angle the nozzle(s) such that a washing fluid jet impinges upon the surface of the aerofoil at more than 75 degrees to the surface and more preferably at between 85 and 90 degrees to the surface.

Alternatively, for the multi-nozzle dispenser, at least two of the nozzles are directed at different surfaces of the aerofoil than each other.

Alternatively, at least one of the nozzles is directed at a first aerofoil and another nozzle is directed at a second aerofoil.

Preferably, the different surfaces of the aerofoil are the pressure side and the suction side.

Preferably, the dispenser comprises a gallery for supplying washing fluid to the nozzle(s).

Preferably, the dispenser is arranged to substantially span the radial extent of the aerofoil, alternatively it is arranged to substantially span the diameter of an annular array of aerofoils.

In another aspect of the present invention there is provided a washing system incorporating a dispenser as described in the above paragraphs, the system includes a control mechanism capable of adjusting the angle of one or more the nozzles.

Preferably, the system comprises a control system for controlling the control mechanism.

Preferably, the system comprises a pump connected via a pipe to a washing fluid reservoir and the washing fluid dispenser is connected via a pipe to the pump.

In yet a further embodiment the present invention provides a method of washing an aerofoil of a gas turbine engine, using a washing fluid dispenser as described in the above paragraphs, the method comprises the step of angling the nozzle at a first part of the aerofoil and is characterised in that in a second step the nozzle is rotated to direct the washing fluid jet at a second region of the aerofoil or another aerofoil.

Preferably, the method comprises a further step of the control system selectively switching on or off the washing fluid flow through each nozzle independently.

Alternatively, the method system comprises a further step of the control system selectively varying the amount of washing fluid ejected by each nozzle.

BRIEF DESCRIPTION OF THE DRAWINGS

The present invention will be more fully described by way of example with reference to the accompanying drawings in which.

DETAILED DESCRIPTION OF THE INVENTION

Figure 1:
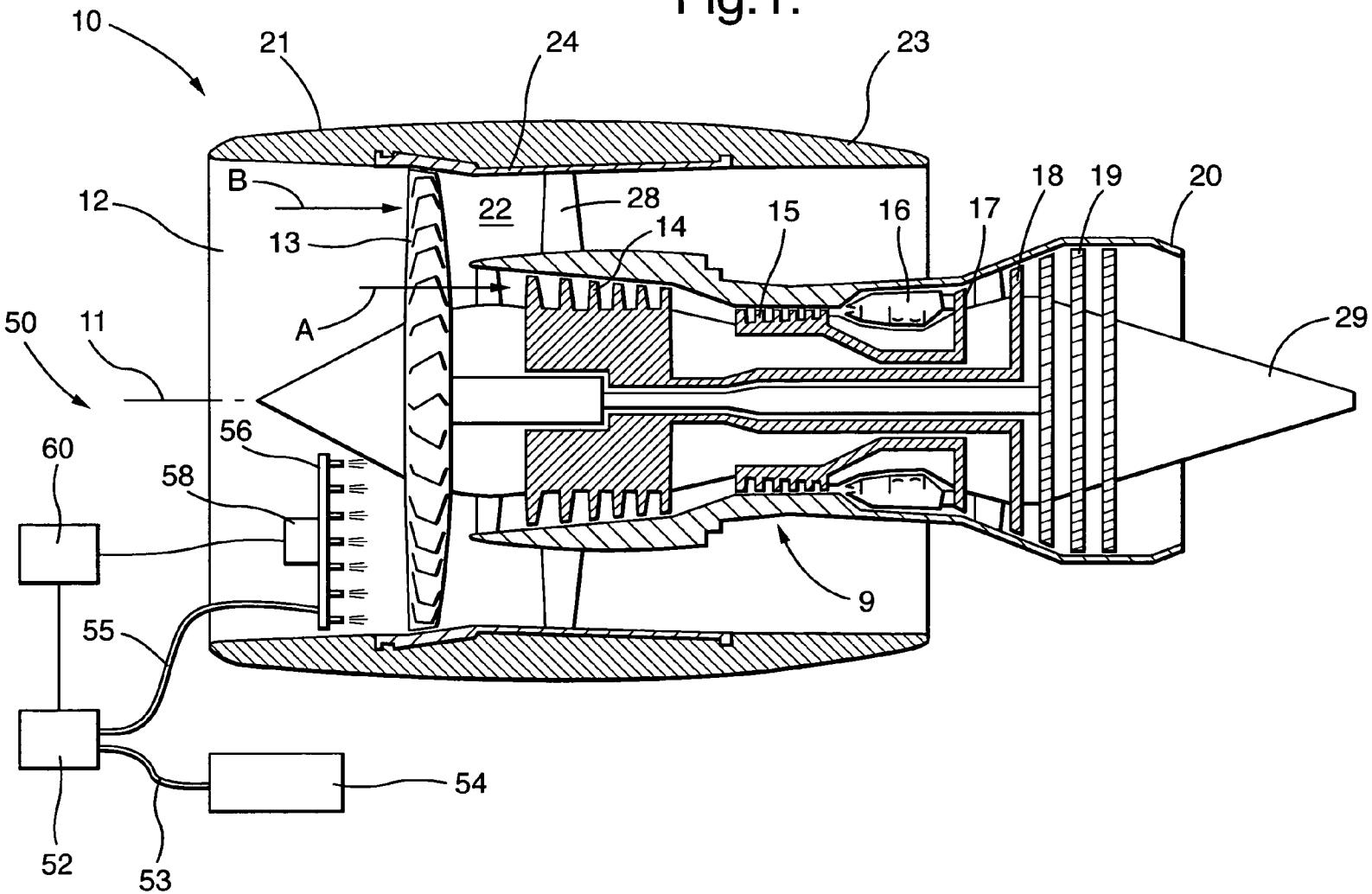
FIG. 1 is a schematic section of part of a ducted fan gas turbine engine and shows a washer system, including a washing fluid dispenser in accordance of the present invention.

Referring to FIG. 1, a ducted fan gas turbine engine generally indicated at 10 has a principal and rotational axis 11. The engine 10 comprises, in axial flow series, an air intake 12, a propulsive fan 13, a core engine 9 comprising an intermediate pressure compressor 14, a high-pressure compressor 15, combustion equipment 16, a high-pressure turbine 17, and intermediate pressure turbine 18, a low-pressure turbine 19 and a core exhaust nozzle 20. A nacelle 21 generally surrounds the engine 10 and defines the intake 12, a bypass duct 22 and an exhaust nozzle 23. A centre-plug 29 is positioned within the core exhaust nozzle 20 to provide a form for core gas flow to expand against and to smooth its flow from the core engine 9.

The gas turbine engine 10 works in the conventional manner so that air entering the intake 12 is accelerated by the fan 13 to produce tow air flows: a first airflow A into the intermediate pressure compressor 14 and a second airflow B which passes through a bypass duct 22 to provide propulsive thrust. The intermediate pressure compressor 14 compresses the airflow A directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high, intermediate and low-pressure turbines 17, 18, 19 respectively drive the high and intermediate pressure compressors 15, 14 and the fan 13 by suitable interconnecting shafts.

The fan 13 is circumferentially surrounded by a structural member in the form of a fan casing 24, which is supported by an annular array of outlet guide vanes 28.

When this engine 10 is washed it may be either non-rotating, cranked via a gearbox (not shown) or at idle speed. Cranking the engine 10 is particularly beneficial when the core engine 9 is washed as the cleaning fluid is forced through the engine's many rows of blades and vanes in the compressors and turbines.

Throughout this specification cleaning of an 'aerofoil' is referred to and it is intended that the term 'aerofoil' is any one of the group comprising the fan blade 30, a compressor blade or vane, an outlet guide vane 28, a static structure-or a bifurcation member. Usually all these structures each have two principle fluid flow surfaces which require cleaning. For example a blade or vane has a pressure side and a suction side, the pressure side being the surface onto which the principle air- or fluid-flow, through the engine 10, impinges upon.

A washing system 50, for washing an above described gas turbine engine 10, in accordance with the present invention, comprises a pump 52 connected via a pipe 53 to a washing fluid reservoir 54 and a washing fluid dispenser 56 connected via a pipe 55 to the pump 52. The dispenser 56 comprises a control mechanism 58 and is connected to a control system 60 that is also connected to the pump 52.

Figure 2:
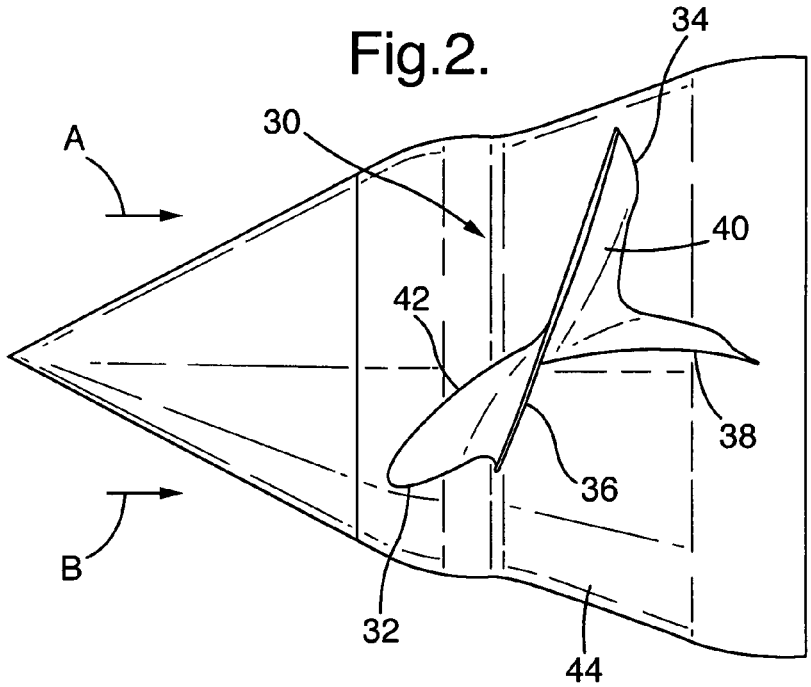
FIG. 2 is a view looking radially inwardly at a fan blade of the gas turbine engine in FIG. 1.
Figure 3:
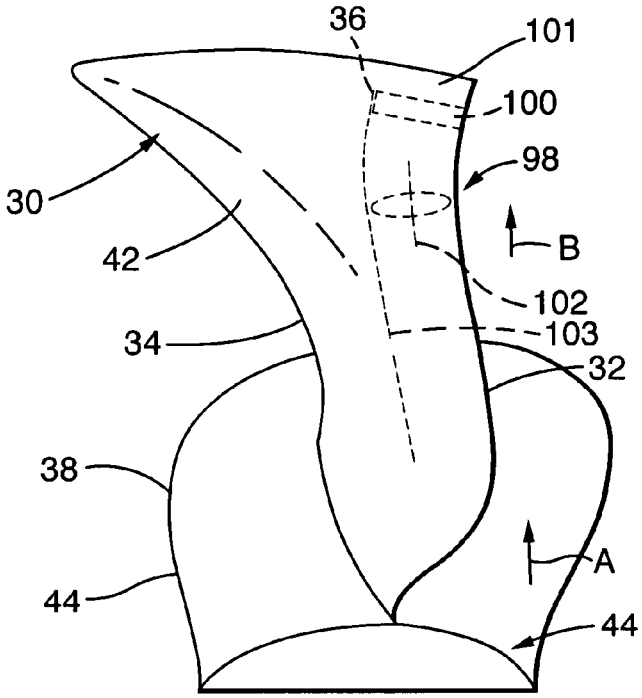
FIG. 3 is a view looking radially inwardly at a fan blade of the gas turbine engine in FIG. 1.

FIGS. 2 and 3 illustrate the arcuate form of a fan blade 30, one of the array of fan blades in the fan 13 of the gas turbine engine 10. The fan blade 30 comprises a leading edge 32 and a trailing edge 34, a blade tip 36 and a blade root region 38 and having pressure and suction surfaces 40, 42 respectively. The blade 30 is attached to a rotor 44 via a dovetail fixture (not shown) or may be attached by other known means. It should be immediately apparent that the surfaces 40, 42 and edges 32, 34 requiring cleaning are not flat and twist between the blade tip 36 and the blade root region 38 as well as curve between the leading edge 32 and the trailing edge 34.

The present applicant has found that a preferred angle of incidence of a jet of cleaning fluid on a surface is 85-90 degrees from the plane of (or tangent at) the, part of the surface being cleaned, i.e. approximately perpendicular. Good results have also been obtained using angles between 75-85 degrees; although it should be appreciated some cleaning will be possible for angles less than 75 degrees. The washing jet issuing from a nozzle is usually divergent and the angles above relate to the centre-line of the washing fluid jet. The less divergent the washing fluid spray the more of the spray is closer to the preferred range of incident angles and hence better cleaning will be realised.

The present applicant has also experienced that the most important region of a fan blade's surface to be cleaned is towards the tip 36 and particularly its leading edge 32 and the surfaces immediately downstream thereof. The trailing edge 34 and the blade's surface just upstream thereof is of secondary importance and the middle portion of a blade is the least important. The suction side is more important to clean than the pressure side due to aerodynamic reasons. However, regions of other aerofoils may be more or less important. Nonetheless it is desirable to clean all aerodynamic surfaces. The importance of cleaning a specific region is dependent on where the aerofoil becomes dirtiest and its degree of influence on aerodynamic performance.

The angle of incidence of a washing fluid jet on a fan blade 30 surface 40, 42 is yet more complex where the fan 13 is rotated during washing. The suction side 42 of the blade 30 is most visible looking into the front of the engine 10 whereas the pressure surface 42 twists away between root 38 and tip 36. During running of the engine, the blade untwists due to centrifugal forces. This is well known in design and operation of fan blades (and other aerofoils). The blade's shape is determined on the angle and velocity of air (or other gas) entering the fan blade array and the rotational speed of the blade. Noting here that the blade 30 is also curved between leading and trailing edges 32, 34 to desirably turn the airflow. The tip of the blades are more 'closed' than at the root as they travel faster and thus the relative angle of incidence of the air flow changes between blade tip 36 and root 38. Similarly, the angle of incidence of a washing fluid jet, directed at a constant or fixed angle, onto the blade 30 will be different between the tip 36 and root 38.

Therefore the angle of incidence of a single divergent jet of cleaning fluid from a fixed angle and position nozzle, as described in WO2005/077554A1, would vary significantly depending on which part of the blade is being cleaned. In WO2005/077554A1 a single nozzle sprays washing fluid over the entire pressure or suction surface of the fan blades, thus the angle of divergence of the jet is significant. In particular it should be noted that the prior art nozzle configuration would result in a washing fluid jet at a low angle (below 45 degrees) of incidence in the most important blade tip region and still a lower angle of incidence at the trailing edge/tip region 36, 34. Therefore WO2005/077554A1 is disadvantaged in that few areas of the fan blades are washed adequately and/or more washing fluid is used to compensate and possibly at a significantly high pressure must be used.

Figure 4:
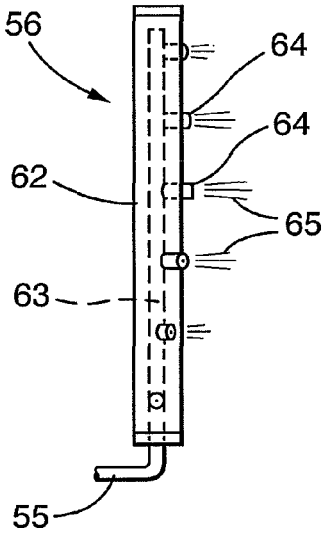
FIG. 4 is a schematic view of a first embodiment of a washing fluid dispenser in accordance of the present invention.

In a first embodiment of the present invention shown in FIG. 4, the washing fluid dispenser is a multi-nozzle dispenser 56 comprising a series of nozzles 64, arranged in a pre-selected array of fixed angles, each capable of producing a washing fluid jet 65. The washing fluid is supplied through pipe 55 and through the hollow body 62 of the dispenser 56, which forms a fluid gallery 63.

For the preferred angle of incidence of the washing fluid jets 65 on the surface 40, 42, the angles of the nozzles 64 are dependent on the particular blade shape which can be different for each different blade type of an engine or different type of aerofoil, as well as which part of the blade 30 each nozzle 64 is ejecting washing fluid on to. As described above the angle of each nozzle 64 is dependent on the blade shape, the relative rotational speed of the blade 30 and the relative velocity of the cleaning fluid jet 65. Nonetheless it is preferred to stay within the desirable range of angles of incidence.

Where the fan blades 30 are not rotated or a static structure such as a vane 28 is being washed then the angles of incidence are dependent on the angle of the nozzle, hence the divergent jet angle if applicable, and the shape of the aerofoil 28, 30.

Figure 5:
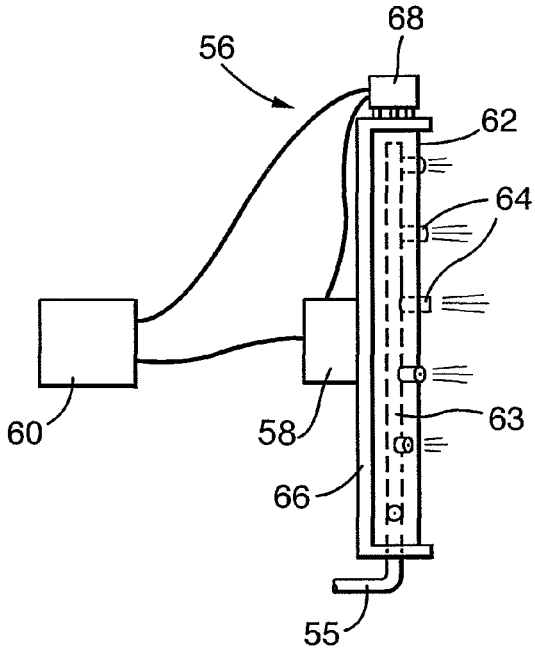
FIG. 5 is a schematic view of a second embodiment of a washing fluid dispenser in accordance of the present invention.

In a second embodiment of the present invention shown in FIG. 5, the multi-nozzle dispenser 56 comprises a hollow body 62 having a series of nozzles 64 arranged in a pre-selected array of fixed angles. The washing fluid is supplied through pipe 55 and then through the gallery 63 to the nozzles 64. The hollow body 62 is rotatably mounted within a sleeve 66. A motor 68 is mounted to the sleeve 66 to rotate the hollow body 62 and therefore alter the angle of the washing fluid jets issuing from the nozzles 64. In use, the sleeve 66 is supported either from a support vehicle or from attachments (not shown) to the engine 10 itself.

Figure 6:
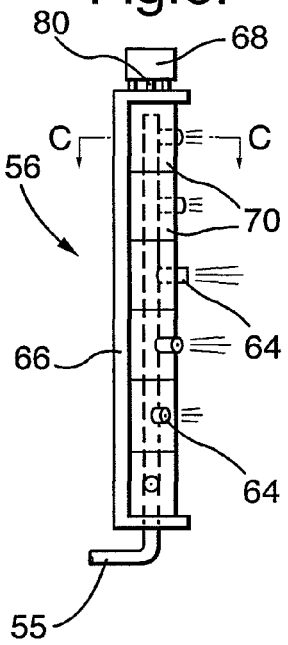
FIG. 6 is a schematic view of a third embodiment of a washing fluid dispenser in accordance of the present invention.

In a third embodiment of the present invention shown in FIG. 6, the multi-nozzle dispenser 56 is similar to the second embodiment and the same reference numbers have been used for the same elements. However, the hollow body 62 comprises a series of segments 70 each having at least one nozzle 64. The segments 70 are rotatably mounted to the sleeve 66 so that a pre-selected array of fixed angles may be selected for each different component or different part of the same component. The washing fluid is supplied through pipe 55 and through the gallery 63 of the dispenser 56 to the nozzles 64. The motor 68 is mounted to the sleeve 66 to rotate the segments 70 and therefore preferentially alter the angle of the washing fluid jets issuing from the nozzles 64.

Figure 7:
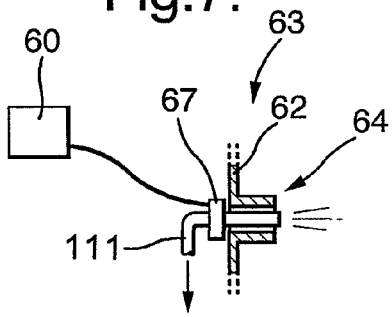
FIG. 7 is a schematic section of a nozzle of a washing fluid dispenser in accordance of the present invention.

The multi-nozzle dispensers 56 of the first, second and third embodiments, may be further improved by inclusion of fluid flow control means 63 as shown in FIG. 7. One example of the fluid flow control means 63 is a controllable valve 67 positioned on a pipe 111 leading to the nozzle 64. An electronic control box 60 is connected to the valve 67 and may therefore be programmed to increase or decrease the volume of fluid flowing through each valve 67 either together or independently. Thus, for example, more washing fluid can be ejected only through the nozzles 64 adjacent the tip 36 of the blade where preferential cleaning is required before the remainder of the nozzles are used to clean the rest of the blade. Alternatively, when the core engine is to be washed the radially outer nozzle valves are closed off and all the washing fluid may be ejected through the radially inner nozzles, i.e. those nozzles adjacent where air flow A enters the core engine 9 in FIG. 1.

The motor 68 of the second and third embodiments is connected to the electronic control box 60 which may be programmed to preferentially rotate the hollow body 62. Alternatively, the sleeve 66 may be rotated about its attachments to a support vehicle or the engine. Furthermore, rotation of the nozzle array may be by hand instead of the motor 68. In this case a simple ratchet mechanism or other similar device may be used to prevent the nozzles 64 from freely rotating.

Figure 8:
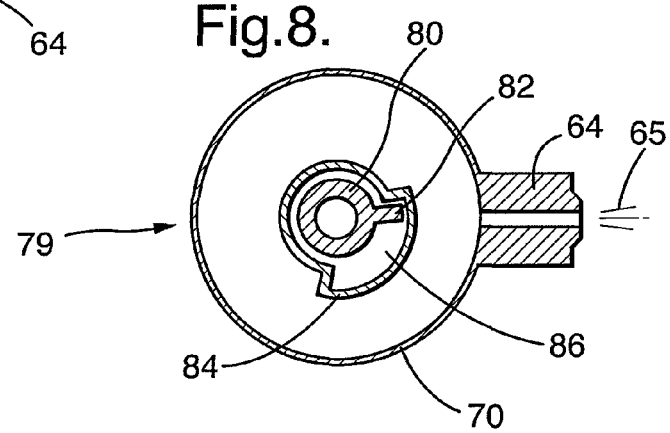
FIG. 8 is a cross-section C-C through the dispenser of FIG. 6.

FIG. 8 shows one suitable rotation mechanism 79 for rotating the segments 70. The rotating mechanism 79 comprises a spindle 80, connected to the controllable motor 68, having a pin 82 which engages with a recess 86 formed in a wall 84 of the segment 70. Some or all of the segments 70 may be rotated in this way and therefore have similar arrangements. The recess 86 extends around part of the rotational axis of the spindle/segment such that by a single rotation of the spindle the rotation of certain segments may be limited as desired. Thus the extent of the recess 86 may be less or more than shown, the smaller the recess the greater the degree of rotation of the segment 70 for a given rotation of the spindle 80.

It should be apparent to the skilled artisan that other mechanisms for rotating the segments 70 may be employed without departing from the scope of the invention. For example each segment 70 may be rotated by an independent drive means.

Figure 9:
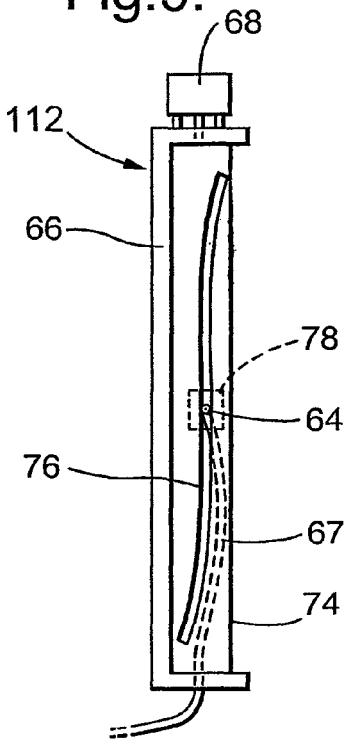
FIG. 9 is a schematic view of a fourth embodiment of a washing fluid dispenser in accordance of the present invention.

In a fourth embodiment of the present invention shown in FIG. 9, a single nozzle dispenser 112 comprises a housing 74 that is preferably generally cylindrical. The housing 74 defines a slot 76 that is a guide for a translatable nozzle 64. The slot 76 is arranged along the length of the housing 74 and extends around part of its circumference. The nozzle 64 is mounted to a slide member 78, arranged to cooperate with the guide 76, and is moved by drive means 68, in this example a motor. In use the nozzle 64 is translated along the guide 76 and the configuration of the guide 76 is such that the nozzle's angle is preferentially inclined so that the washing fluid jet impinges onto the surface 40, 42 of the blade 30 at a preferred angle. The shape of the guide is complimentary to the leading edge of the fan blade 30. For other aerofoil shapes the housing 74 and the guide may be differently arranged to direct the nozzle. For example a convex housing may be used rather than the concave version shown.

Figure 10:
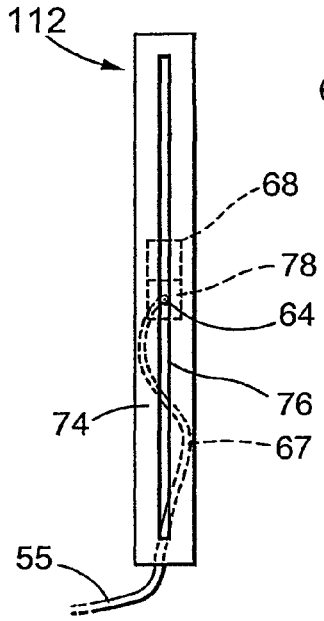
FIG. 10 is a schematic view of a fifth embodiment of a washing fluid dispenser in accordance of the present invention

In a fifth embodiment of the present invention shown in FIG. 10, a single nozzle dispenser 112 comprises a housing 74 that is preferably generally cylindrical, but may be other cross-sectional shapes. The housing 74 defines a slot 76 that acts as a guide for a translatable nozzle 64. The slot 76 is arranged along the length of the housing 74 and is straight, although an arcuate slot as described with reference to FIG. 10 may be used. The nozzle 64 is mounted to a slide member 78, arranged to cooperate with the guide 76, and moved by drive means 68, in this example a motor. A pinion connected to the drive means 68 is associated with a rack on an inside surface of the housing 74. In use the nozzle 64 is translated along the guide 76 and the configuration of the guide 76 is such that the nozzle's angle is preferentially inclined so that the washing fluid jet impinges onto the surface 40, 42 of the blade 30 at a preferred angle. The nozzle 64 is rotatable in order to desirably angle the washing fluid jet 65 onto the surface 40, 42 of the aerofoil 30, 28.

One simple mechanism for rotating the nozzle is described below with reference to FIG. 11, however, it should readily be understood that the skilled artisan might employ other rotatable mechanisms without departing from the scope of the present invention.

In the fourth and fifth embodiments, shown in FIGS. 9 and 10, the movable nozzle 64 is supplied with washing fluid via a flexible pipe 67 to allow translation of the nozzle 64 along the slots 76. The housings 74 shown in FIGS. 9 and 10 may also be shaped from top to bottom for even more preferential angling of the nozzle.

Figure 11:
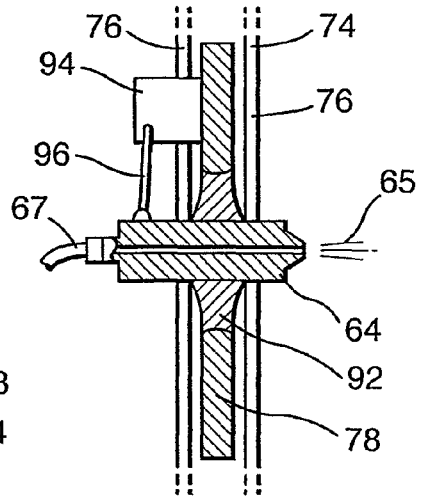
FIG. 11 is a schematic section of a rotatable nozzle of the washing fluid dispenser.

FIG. 11 shows the slide member 78 slidably mounted within a guide channel defined by the housing 74. The nozzle 64 is captured by a resilient collar 92, which allows rotation of the nozzle 64. A rotation drive 94 is connected to one end of the nozzle 64 via a link 96 such that movement of the link 96 by the drive 94 causes rotation, in a first plane, of the nozzle 64. A second rotation drive 94 and link 96 (not shown for clarity) is positioned perpendicular to the first drive and link to provide rotation of the nozzle within a second plane. Thereby the two rotation means are capable of desirably angling the nozzle 64 in three dimensions.

Figure 12:
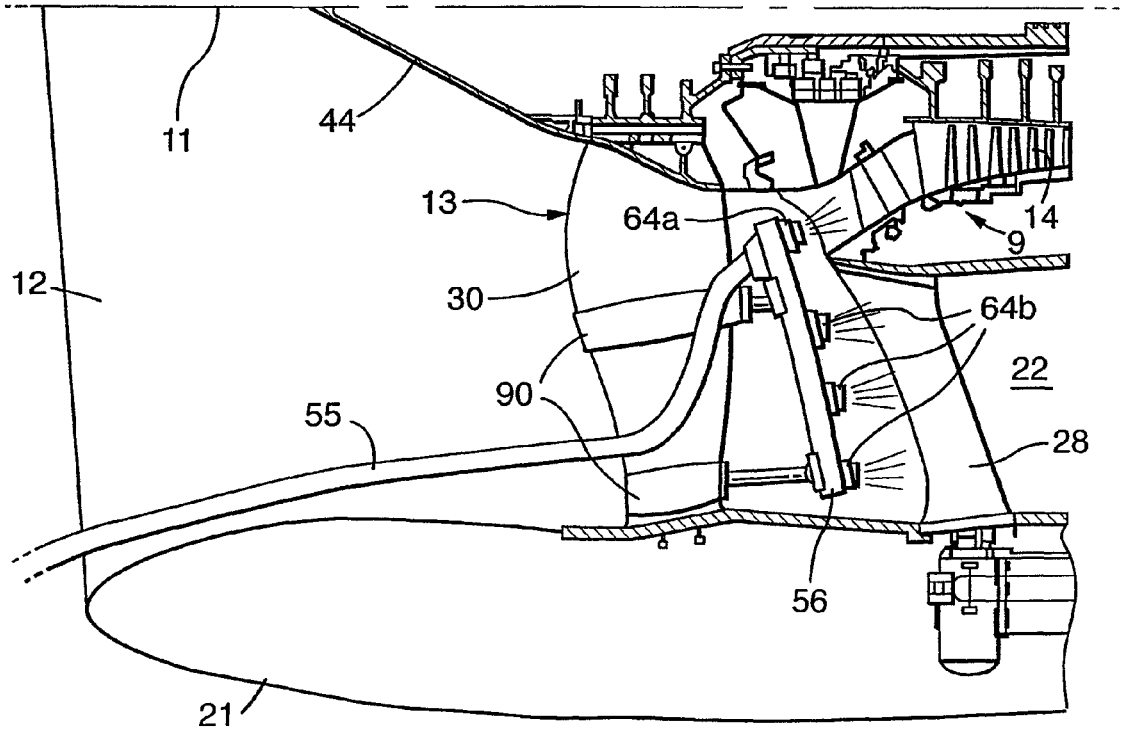
FIG. 12 is a schematic section of part of the gas turbine engine with a washing fluid dispenser positioned for washing.

FIG. 12 shows the dispenser 56, 112 secured via straps 90 to one of the fan blades 30. In this way, the core engine 9 may be cleaned thoroughly as well as the outlet guide vanes 28. Although core engine washing is achievable through the fan blade array 13, as described earlier, the fan blades 30 can block some of the washing fluid. Here again, radially inward nozzle 64*a* and outer nozzles 64*b* may be operated together or separately to maximise cleaning efficiency.

Additionally the dispenser 56, 112 of the present invention is advantaged over the prior art because the washing fluid jets do not diverge as greatly and therefore the angle of incidence for the whole spray jet is closer to the preferred range. In the prior art, one nozzle only is provided to spray washing fluid over the entire pressure or suction side of the fan blade, thus the washing jet's spray angle is particularly divergent and the outer parts are incident on a fan blade well outside optimum angles. For the present invention, either embodiments with multiple nozzles or the single translatable nozzle embodiment are advantaged in that their spray angle is much less divergent resulting in improved aerofoil washing. This has benefits greater than a skilled person would readily appreciate in that the leading edge and surfaces may be preferentially cleaned with a greater percentage of the total volume of washing fluid used and in a shorter period of time. Further the angle of incidence of any washing jet along the blade's length is kept nearer to the optimum angle, which means that critical areas of the fan blade may be cleaned more thoroughly than using the prior art system. Not only is there an aerodynamic benefit, but also the time between washing operations may be increased relative to prior art systems.

Other derivatives of the present invention may be made without departing from the scope of the present invention. For example, two dispensers 56, 112 may be used in conjunction one cleaning the suction surface and one the pressure surface. Alternatively, the dispenser may extend across the diameter of the fan 13 and/or the nozzles in one half of the dispenser may be directed to the pressure side and the other half the suction side or perhaps a different part of the same side. Still further, alternate nozzles may be directed at the pressure and suction surfaces.

Figure 13A:
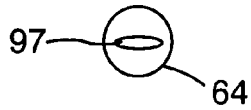
FIGS. 13*a* and 13*b* show a view on two outlets of a washing fluid nozzle.
Figure 13B:
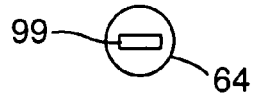

Referring back to FIG. 3 and FIGS. 13*a* and 13*b*, although traditionally an outlet 97 of a nozzle 64 is generally elliptical and therefore it produces a generally elliptical (and usually divergent) shaped jet of washing fluid 98, yet a further advantage of the present invention is realised with a generally rectangular shaped outlet 99. The advantage here is that the area 101 on FIG. 3, the leading edge 32 and adjacent surface, is more evenly sprayed with the resultant elongate jet 100 than an elliptical or even circular jet 98. Therefore improved cleaning is achieved by virtue of all the surface being cleaned evenly rather than preferentially along the centre line 102—being subject to more washing fluid than the outer parts near the leading edge or boundary line 103. In this way less cleaning fluid is used for the same quality of cleaning or an improved surface finish provided than previously the case.

A further aspect of the present invention is a method of washing an aerofoil of a gas turbine engine. The aerofoil 30, 28 and washing fluid dispenser 56, 112 are as defined hereinbefore. The method comprises the step of angling the nozzle 64 at a first part of the aerofoil, e.g. the suction surface adjacent the leading edge, and is characterised by a second step where the nozzle 64 is rotated to direct the washing fluid jet at a second region of the aerofoil e.g. the suction surface adjacent the trailing edge or the pressure side or another aerofoil.

The method comprises the further step of the control system 60 selectively switching on or off the washing fluid flow through each nozzle 64 independently, thereby either concentrating a washing fluid flow onto specific regions of the surface being cleaned or directing washing fluid only into the core engine 9 for example or through each nozzle sequentially on dispenser 56. Similarly, the method may comprise yet another step of the control system 60 being programmed to selectively vary the amount and pressure of washing fluid ejected by each nozzle 64. In this step, critical and non-critical airflow surface areas may have increased or decreased levels of washing jet intensity and therefore better cleaning and less wasted washing fluid is realised than previous methods of engine washing.

We claim:

1. A method for washing an aerofoil of a gas turbine engine having a principal and rotational axis using a multi-nozzle dispenser, the aerofoil comprising:

a fan blade, a compressor blade or vane, or an outlet guide vane, the aerofoil having a suction surface and a pressure surface, the suction and pressure surfaces having a curve between a leading edge and a trailing edge and a twist between a blade tip and a blade root region, the multi-nozzle dispenser comprising:

an elongated hollow body defining a fluid gallery within the hollow body, the hollow body having an axis extending a length of the hollow body;

a plurality of nozzles located along the length of the hollow body connected to the fluid gallery so that washing fluid can flow through the fluid gallery and then into the nozzles during use; and at least a first nozzle and a second nozzle being angled at different angles about the hollow body axis and being arranged to eject a washing fluid at different angles relative to said rotational axis and, in use, each nozzle ejects said washing fluid onto different parts of the pressure surface or suction surface, wherein the first nozzle is angled such that a washing fluid jet impinges upon the pressure surface or the suction surface at more than 75 degrees to the surface, and the second nozzle is angled such that a washing fluid jet impinges upon the same pressure surface or suction surface as the first nozzle and at more than 75 degrees to the pressure surface or suction surface, wherein the hollow body comprising a plurality of segments, at least two of the segments having at least one nozzle mounted thereon and being rotatably mounted so that the rotatable segments can each be independently rotated and so that the rotatable segments can be rotated to change the angles of the first and second nozzles about the hollow body axis; said method comprising:

locating said multi-nozzle dispenser into said gas turbine engine;

angling the first nozzle and supplying washing fluid to the first nozzle so that the washing fluid jet impinges upon the pressure surface or suction surface at more than 75 degrees to the pressure surface or suction surface; and angling the second nozzle and supplying washing fluid to the second nozzle so that the washing fluid jet from the second nozzle is ejected onto a different part of the same pressure surface or suction surface than the washing fluid jet ejected from the first nozzle impinges and at more than 75 degrees to the pressure surface or suction surface.

2. A method according to claim 1, wherein the hollow body is rotatably mounted so that the hollow body can be rotated to adjust the angle of the first and second nozzles and direct the first and second nozzles at different parts of the pressure or suction surface of the aerofoil.

3. A method according to claim 1, wherein the hollow body comprises at least two segments, at least one nozzle being mounted on each segment, at least one of the segments being rotatably mounted so that the rotatable segment can be rotated to change the angle of the first and second nozzles about the hollow body axis.

4. A method according to claim 1, wherein the nozzle comprises an outlet that is substantially elliptical and the method further comprises producing a generally elliptical shaped jet of washing fluid.

5. A method according to claim 1, wherein the nozzle comprises an outlet that is rectangular and the method further comprising producing a high aspect ratio shaped jet of washing liquid.

6. A method according to claim 1, wherein the first nozzle is angled so that the washing fluid jet impinges upon the first part of the surface of the aerofoil between 85 degrees and 90 degrees to the surface of the aerofoil.

7. A method according to claim 1, wherein the first nozzle is angled such that a washing fluid jet impinges upon the surface of the aerofoil at between 85 and 90 degrees to the surface.

8. A method according to claim 1, wherein the dispenser comprises a gallery for supplying washing fluid to the hollow member and then to the first nozzle.

9. A method according to claim 1, wherein the dispenser is arranged to substantially span the radial extent of the aerofoil.

10. A method according to claim 1, wherein the dispenser is arranged to substantially span the diameter of an annular array of aerofoils.

11. A method according to claim 1, wherein a washing system incorporates said multi-nozzle dispenser, and wherein said washing system comprises a control mechanism capable of adjusting the angle of one or more the nozzles, the method further comprising using the control mechanism to adjust the angle of one or more of the nozzles.

12. A method according to claim 11, wherein the washing system comprises a control system for controlling the control mechanism, the method further comprising using the control system to control the control mechanism.

13. A method according to claim 11, wherein the washing system comprises a pump connected via a pipe to a washing fluid reservoir and the multi-nozzle dispenser is connected via a pipe to the pump, the method further comprising pumping washing fluid from the fluid reservoir to supply the washing fluid to the nozzle.

14. A method according to claim 12, wherein the control system selectively switches on or off the washing fluid flow through each nozzle independently.

15. A method according to claim 12, wherein the control system selectively varies the amount of washing fluid ejected by each nozzle.

16. A method according to claim 1, wherein a washing system incorporates said multi-nozzle dispenser, and wherein said washing system comprises a control mechanism capable of adjusting the angle of one or more of the nozzles by rotating the rotatable sections, the method further comprising using the control mechanism to adjust the angle of one or more of the nozzles by rotating the rotatable sections.

17. A method according to claim 16, wherein the washing system comprises a control system for controlling the control mechanism, the method further comprising using the control system to control the control mechanism.

18. A method according to claim 16, wherein the washing system comprises a pump connected via a pipe to a washing fluid reservoir and the hollow member is connected via a pipe to the pump, the method further comprising pumping washing fluid from the fluid reservoir to supply the washing fluid to the hollow member and the nozzle.

19. A method according to claim 16, wherein the control system selectively switches on or off the washing fluid flow through each nozzle independently.

20. A method according to claim 16, wherein the control system selectively varies the amount of washing fluid ejected by each nozzle.

* * * * *